US009447594B2

(12) United States Patent
Foster et al.

(10) Patent No.: US 9,447,594 B2
(45) Date of Patent: Sep. 20, 2016

(54) INGROUND POOL WALL AND DECK SUPPORT

(75) Inventors: Charles M. Foster, Schenectady, NY (US); David A. Steele, Gansevoort, NY (US); Collin J. Sirco, Ballston Lake, NY (US)

(73) Assignee: RADIANT INTELLECTUAL PROPERTIES LLC, Albany, NY (US)

( * ) Notice: Subject to any disclaimer, the term of this patent is extended or adjusted under 35 U.S.C. 154(b) by 313 days.

(21) Appl. No.: 13/487,839

(22) Filed: Jun. 4, 2012

(65) Prior Publication Data

US 2012/0304373 A1 Dec. 6, 2012

Related U.S. Application Data

(60) Provisional application No. 61/492,528, filed on Jun. 2, 2011.

(51) Int. Cl.
*E04H 4/00* (2006.01)
*E04H 4/14* (2006.01)

(52) U.S. Cl.
CPC ..... *E04H 4/141* (2013.01); *E04H 4/0087* (2013.01); *E04H 2004/0068* (2013.01)

(58) Field of Classification Search
USPC ..... 4/506; 52/169.7, 657, 695, 636, 638, 52/653.1, 645
See application file for complete search history.

(56) References Cited

U.S. PATENT DOCUMENTS 3,108,406 A * 10/1963 Ellis ..... 52/577
3,444,659 A * 5/1969 Shanni ..... 52/149
3,610,564 A * 10/1971 Mattingly ..... 249/68
4,124,907 A * 11/1978 Laven ..... 52/169.7
4,232,491 A * 11/1980 Bumgarner, Sr. ..... 52/169.7

* cited by examiner

*Primary Examiner* — Lauren Crane
(74) *Attorney, Agent, or Firm* — Bond, Schoeneck & King, PLLC; Frederick Price; George McGuire

(57) ABSTRACT

The present invention provides a pool wall and deck support member including modular and symmetrical upper and lower halves adapted to be interconnected to one another to form a unitary support member. Each half is essentially V-shaped with the bottom of the V having a pair of fastening elements disposed thereon and adapted to securely engage corresponding fastening elements disposed on the bottom of the V of the opposite half. Disposed on the ends of the upwardly extending legs of the V-shaped members are fastening elements that are adapted to engage a cross bar that extends across the V-shaped member.

13 Claims, 24 Drawing Sheets

INGROUND POOL WALL AND DECK SUPPORT

CROSS REFERENCE TO RELATED APPLICATION

The present application claims priority to U.S. Provisional Patent Application Ser. No. 61/492,528, filed Jun. 2, 2011, the entirety of which is hereby incorporated by reference.

BACKGROUND OF THE INVENTION

1. Field of the Invention

The present invention relates generally to support structures for the walls and decking that define an inground swimming pool.

2. Description of the Related Art

Construction of an inground swimming pool involves excavating the land area where the swimming pool is to be located. Typically, the excavation extends for about 2-3 feet beyond the outer dimensions of where the pool's walls will be fixed in place. Once the hole is dug, the walls that provide the structural rigidity and shape to the pool are set in position and interconnected to one another. As shown in FIG. 1, an A-Frame brace is then set against the exterior surface of each wall to maintain the walls plumb. A concrete bond beam is poured along the exterior base of the pool walls and bottom leg of the braces to provide a locking collar to prevent the walls from collapsing after water fills (and creates pressure against the walls of) the pool.

After the concrete has hardened, the ditch that exists between the undisturbed earth and the exterior surface of the pool walls is back filled with dirt from the excavated hole while the pool is filled with water. Once the fill has settled, a 4-6 inch thick by 3-4 feet wide concrete deck is installed around the exterior perimeter of the pool. If the decking is poured prior to the backfill being fully settled, cracking and breaking of the concrete deck will likely occur causing the deck to slip inwardly towards the pool, potentially causing the pool's walls to shift and eventually leading to significant repairs being required to maintain the pool.

It is a principal object and advantage of the present invention to provide a support structure for concrete decking that permits the decking to be poured regardless of whether the back fill has settled.

It is another object and advantage of the present invention to provide support structure for concrete decking that is adjustable to accommodate pool walls of varying heights.

It is a further object and advantage of the present invention to provide support structure for concrete decking that may be used with straight or curved pool walls and with walls composed of different materials.

Other objects and advantages of the present invention will in part be obvious and in part appear hereinafter.

SUMMARY OF THE INVENTION

In accordance with the foregoing objects and advantages, the present invention provides a pool wall and deck support member comprising modular and symmetrical upper and lower halves adapted to be interconnected to one another to form the unitary support member. Each half is essentially V-shaped with the bottom of the V having a pair of fastening elements disposed thereon and adapted to securely engage corresponding fastening elements disposed on the bottom of the V of the opposite half. Disposed on the ends of the upwardly extending legs of the V-shaped members are fastening elements that are adapted to engage a cross bar that extends across the V-shaped member. While each half of the V-shaped members are approximately equal to half the height of a standard pool wall (e.g., about 21 inches each), extension modules having correspondingly shaped and positioned fastener elements disposed on opposing sides thereof may be disposed and interconnected between the two halves to increase their height to accommodate walls of varying heights. The modules can be of whatever thickness (or height) is necessary, and several extension modules can be interconnected between the two halves to satisfy the height requirement.

Cross bars are connected across both the top and bottom of the support module (the top cross bar extending across the top of the upper V-shaped member and the bottom cross bar extending across the bottom of the upside down oriented V-shaped module). Each cross bar includes a flange that may be fastened to the pool walls, or to the splines of the pool walls so as to interconnect the support structure to the pool walls. The attachment mechanism is adjustable in dimension to ensure that the support member can be connected to the wall in a manner that establishes and maintains the wall plumb in an essentially vertical plane. In addition to the attachment mechanism, a series of clips having rebar support yokes are placed over the top cross bar.

Once the series of assembled support members are fastened to the pool walls, a concrete bond beam of approximately 8 inch thickness may be poured in the ditch between the undisturbed earth and the bottom of the pool walls. Once hardened, the concrete bond beam will secure the support member is position relative to the pool walls.

Back fill may then be used to fill in the space above the concrete bond beam and the remainder of the excavated site between the undisturbed earth and pool walls. Once backfilled (or prior to backfilling if desired), steel rebars may be extended between adjacent support members, with each length of rebar seated in the yokes that are positioned atop each upper cross bar. Once the rebars are in place a concrete deck may be poured over the top of the backfill. The steel rebars will be encapsulated within the concrete deck and the weight of the deck will be fully supported by the support members, with each section of decking extending between two adjacent support members.

BRIEF DESCRIPTION OF THE DRAWINGS

The present invention will be more fully understood and appreciated by reading the following Detailed Description in conjunction with the accompanying drawings, in which.

DETAILED DESCRIPTION

Figure 1:
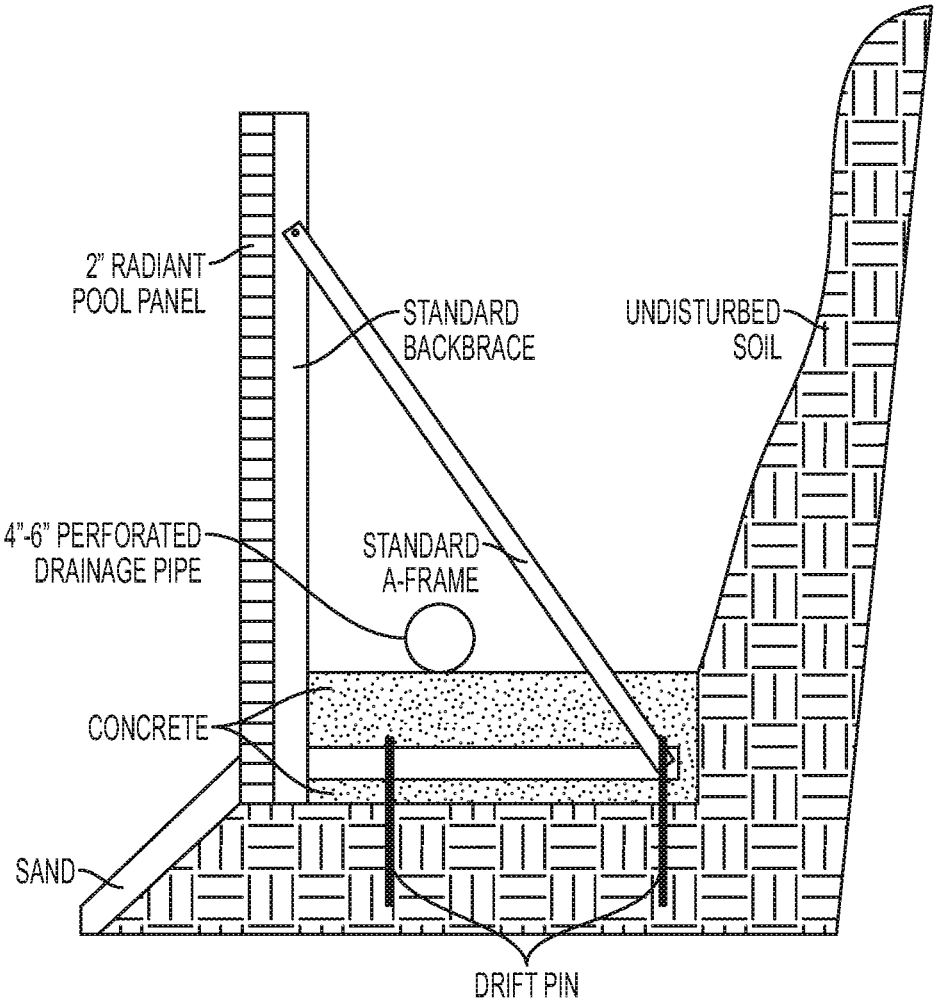
FIG. 1 PRIOR ART
FIG. 1 is a partial cross-section view of a prior art pool wall support system.
Figure 2:
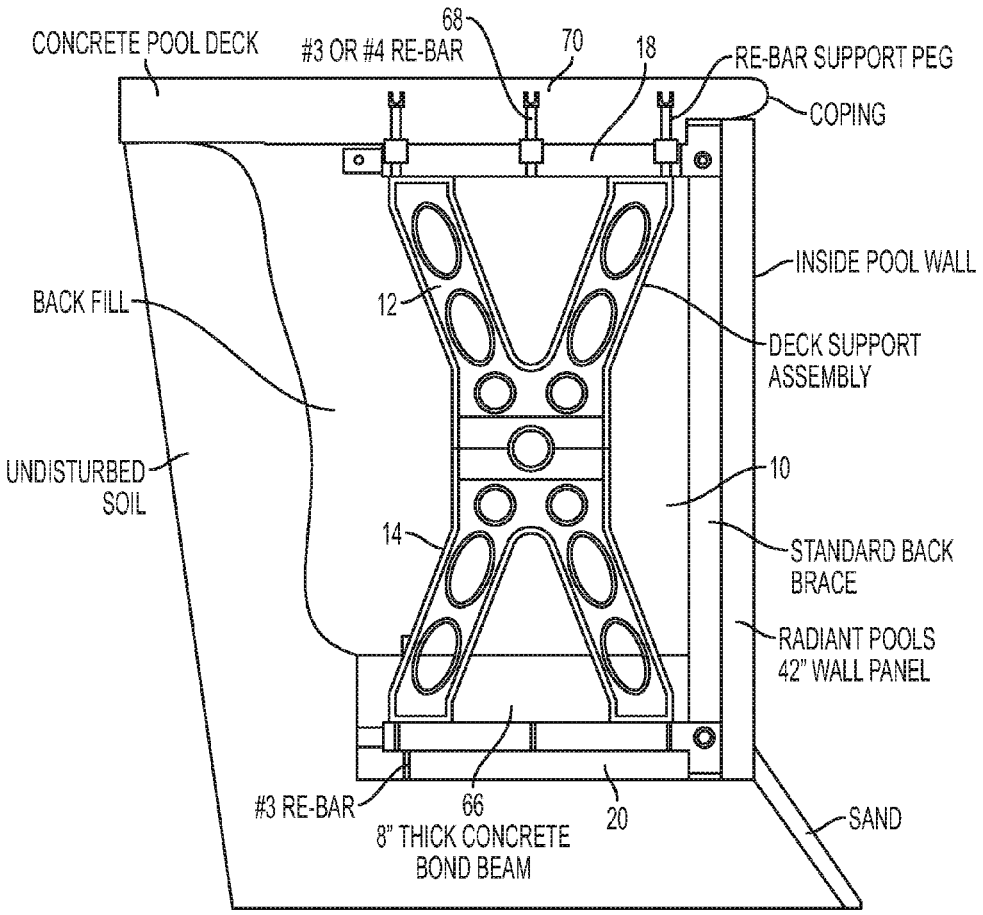
FIG. 2 is a side elevation view of a pool wall support system made in accordance with the present invention.
Figure 3A:
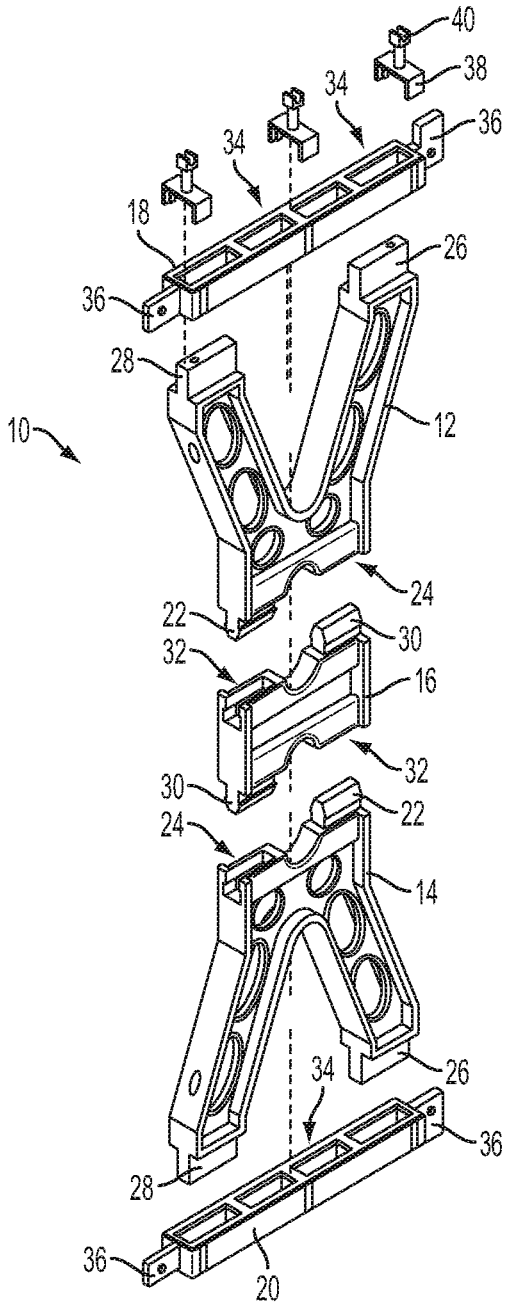
FIGS. 3A and 3B are exploded and perspective views, respectively, of a first embodiment of the support member.
Figure 3B:
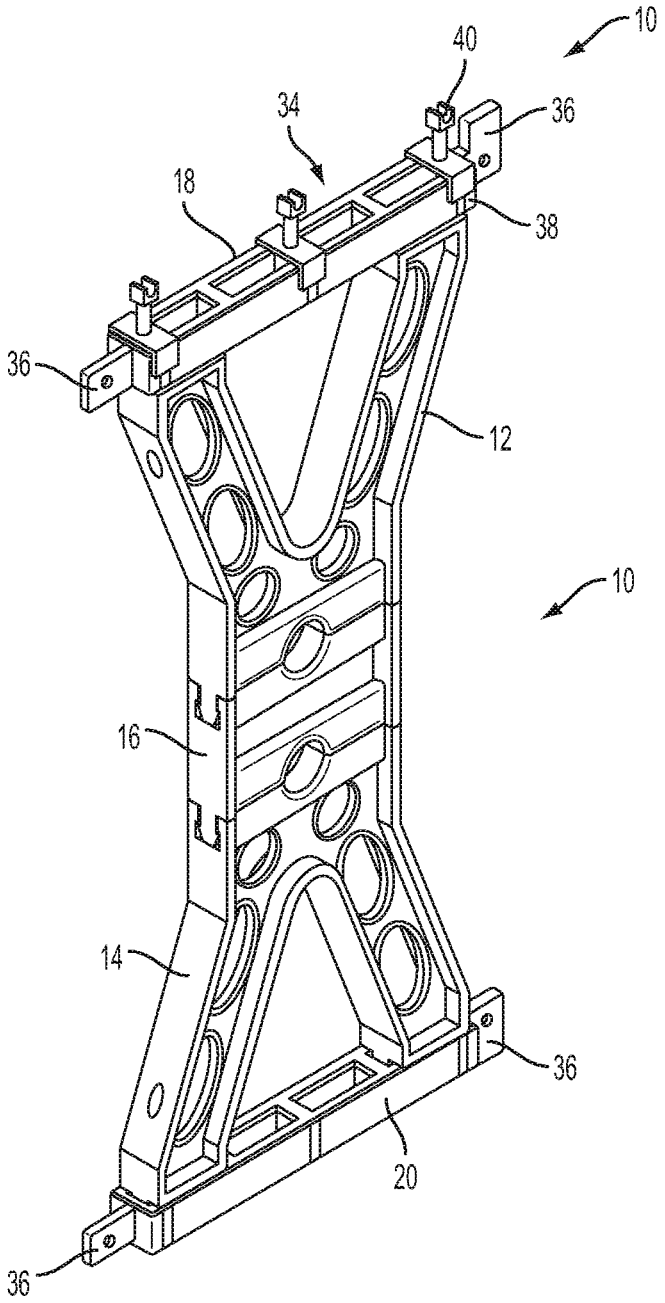
Figure 4A:
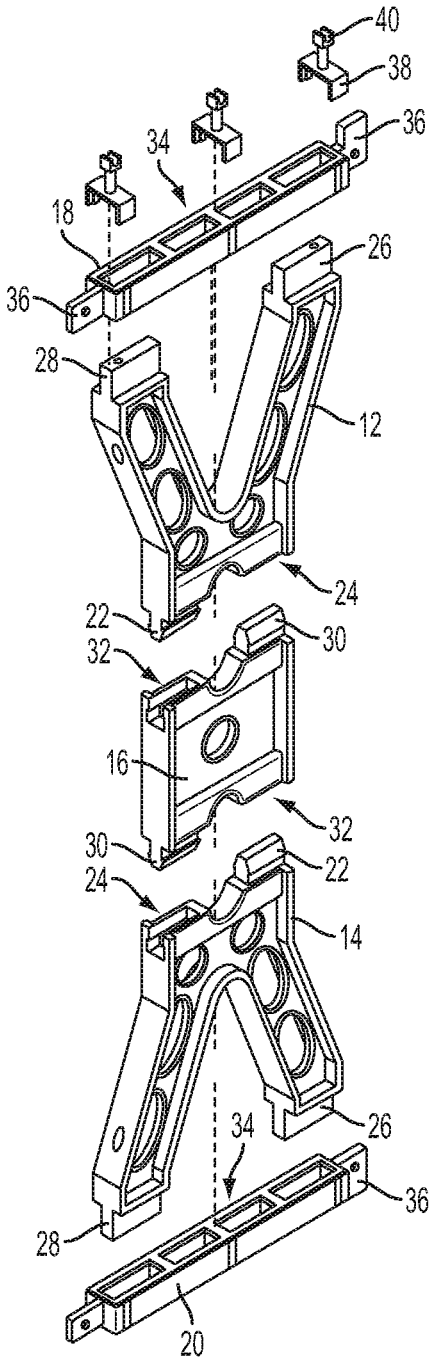
FIGS. 4A and 4B are exploded and perspective views, respectively, of a second embodiment of the support member.
Figure 4B:
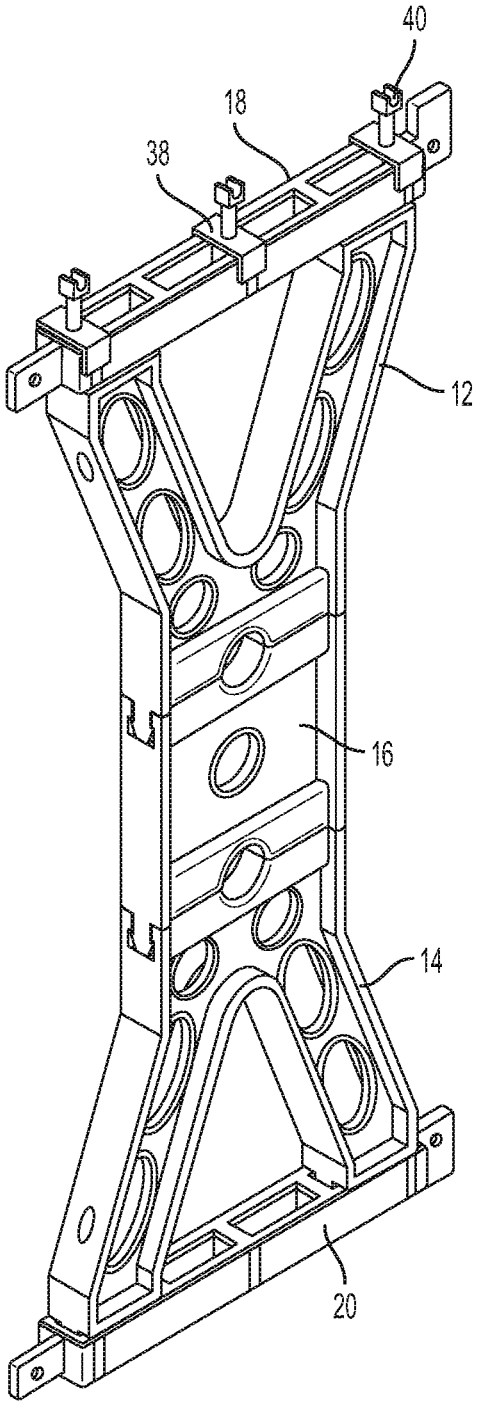
Figure 5A:
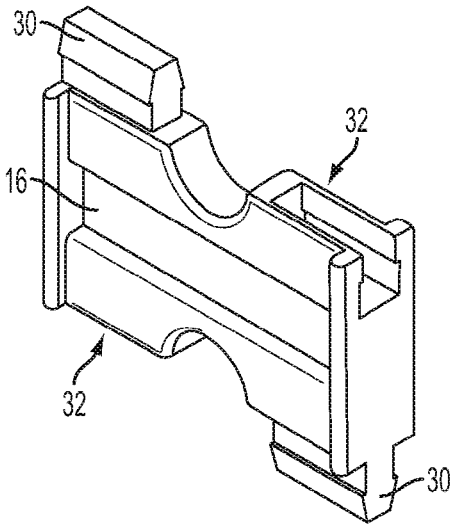
FIGS. 5A-5E are views of a first extension block.
Figure 5B:
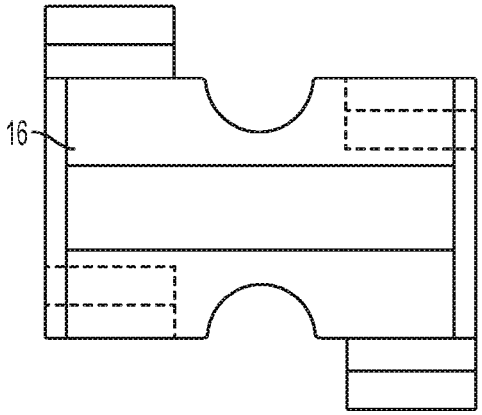
Figure 5C:
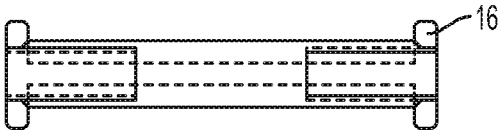
Figure 5D:
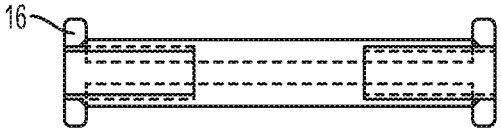
Figure 5E:
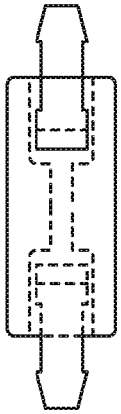
Figure 6A:
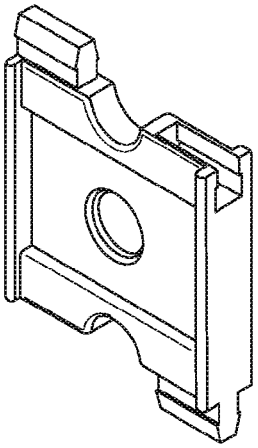
FIGS. 6A-6E are views of a second extension block.
Figure 6B:
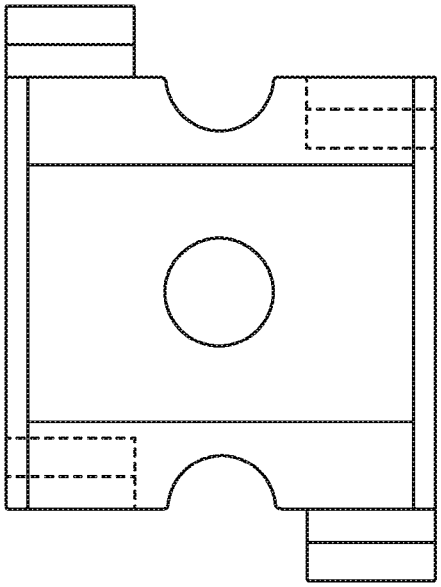
Figure 6C:
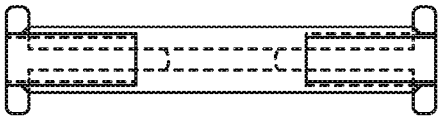
Figure 6D:
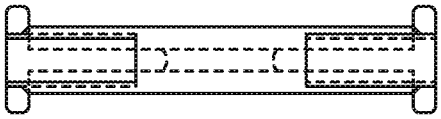
Figure 6E:
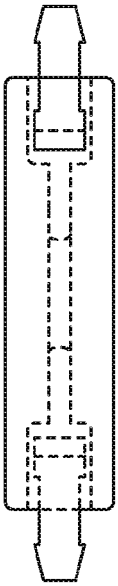
Figure 7A:
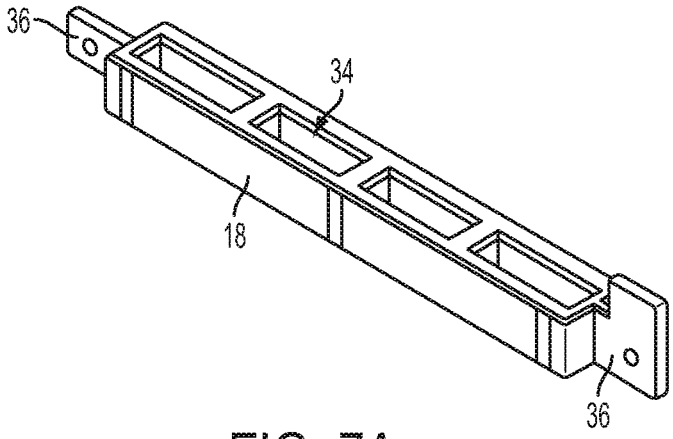
FIG. 7A-7D are views of a cross bar.
Figure 7B:
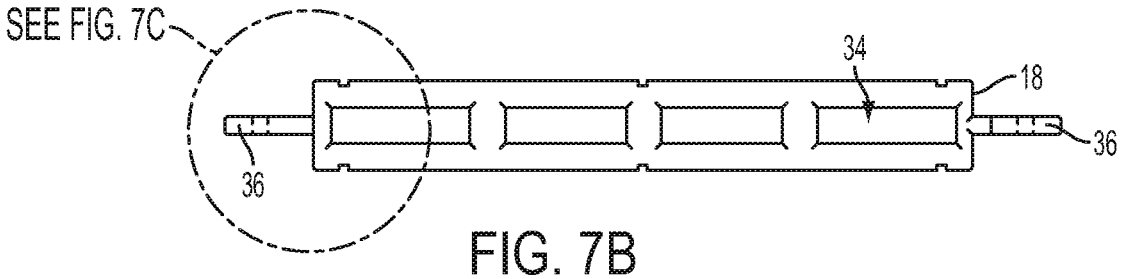
Figure 7C:
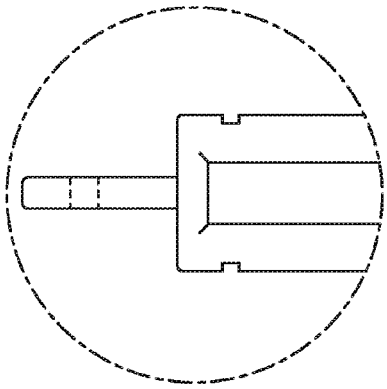
Figure 7D:
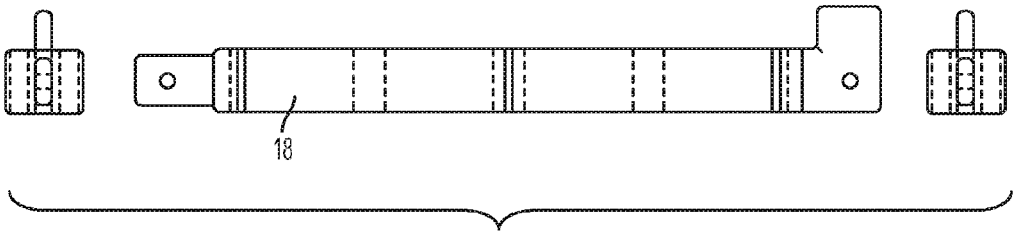
Figure 8A:
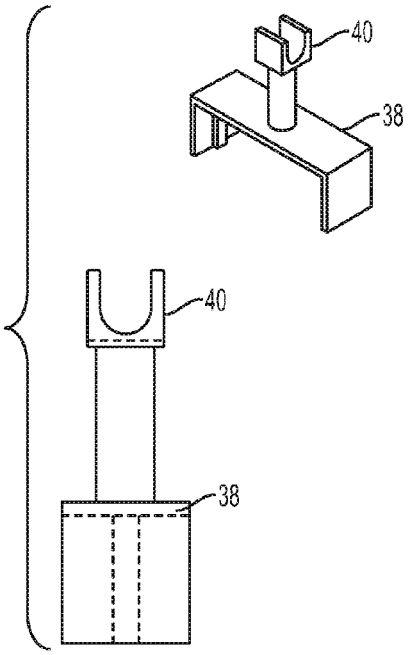
FIGS. 8A-8B are views of a rebar support member.
Figure 8B:
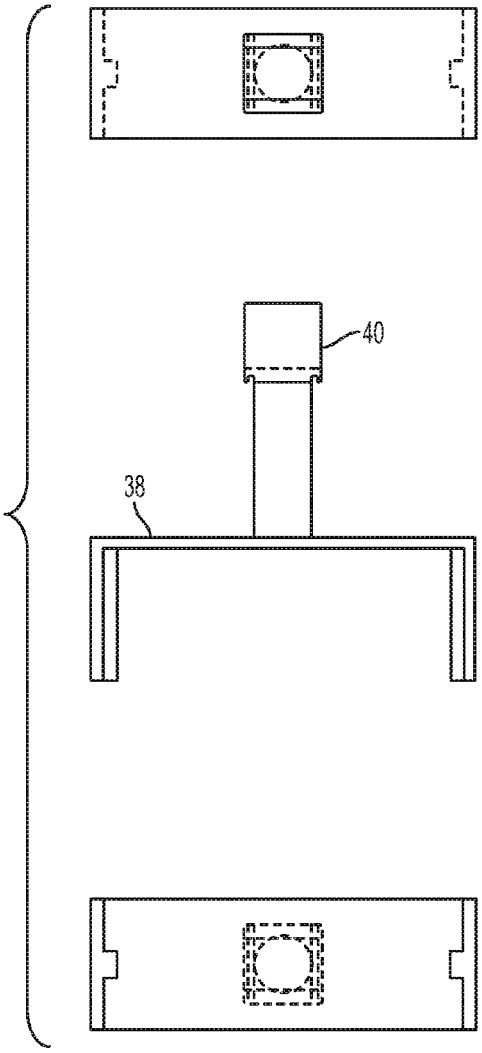
Figure 9A:
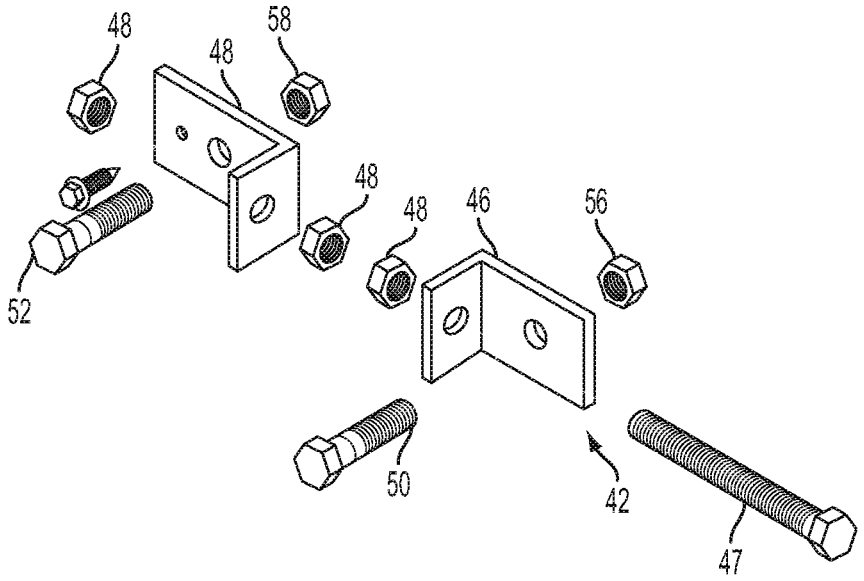
FIGS. 9A-9E are views of a top adjustment mechanism.
Figure 9B:
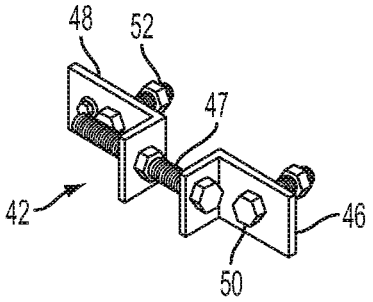
Figure 9C:
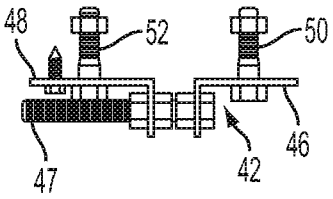
Figure 9D:
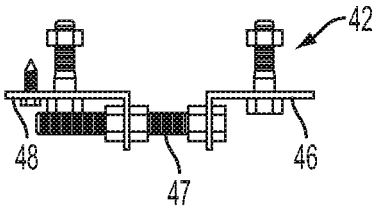
Figure 9E:
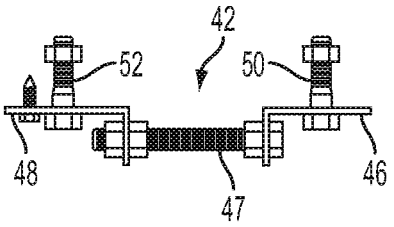
Figure 10A:
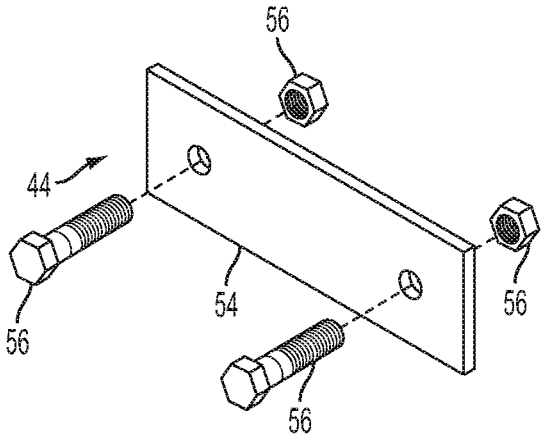
FIGS. 10A-10B are views of a bottom adjustment mechanism.
Figure 10B:
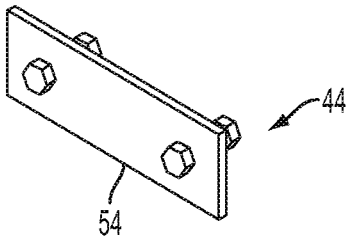

Reference being had to the drawings, wherein like reference numerals refer to like parts throughout, there is seen in FIG. 3. among others, a generally X-shaped pool wall and deck support member, designated generally by reference numeral 10, comprising modular and symmetrical, upper and lower V-shaped elements 12, 14, respectively, interconnected to one another at their respective vertices to form the X-shaped support member 10. With reference to FIGS. 3, 5 and 6, one or more extension modules 16 may be interconnected between the V-shaped elements 12 and 14 to extend the height of the support member 10 and accommodate pool walls of varying heights. Support member 10 further comprises upper and lower cross members 18 and 20, respectively, which extend in a common plane with support member 10 and between the terminal ends of the upper and lower elements 12 and 14, respectively.

Each element 12 and 14 includes a male and female connector/fastening element 22, 24, respectively, formed on each element's vertex, as well as a pair of male connectors/fastening elements 26, 28 formed on the end of each leg. In assembling support member 10, the male connector 22 of one element 12 is securely engaged with the female connector 24 on the opposing element 14, and the female connector 24 of one element 12 is securely engaged with the male connector 22 with the opposing element 12. Each extension module 16 includes male and female connectors 30, 32 formed on each of its edges, which are positioned for secure engagement with corresponding female and male connectors 24, 22, respectively, when extension modules are used for increasing the height of support module 10.

The cross members 18 and 20 each include a plurality of longitudinally spaced apart, slotted openings 34 formed therethrough, and connecting members 36 extending longitudinally outwardly from the cross members. Each cross member is affixed to element 12 or 14 by securely inserting male connectors 26, 28 through correspondingly positioned openings 34. As an alternate accessory, clips 38 may be securely placed over the top of upper cross member 18. Each clip 38 includes a yoke 40 extending upwardly therefrom that is adapted to have a length of steel rebar seated therein for purposes that will be described hereinafter.

Connecting mechanisms 36 interact with an upper attachment mechanism 42 to interconnect the top cross member 18 to pool wall 15 and with a lower attachment mechanism 44 to interconnect cross bar 20 to pool wall. Upper attachment mechanism 42 includes a pair of adjustment angles 46, 48 interconnected by a bolt 47 and nuts 48, and a pair of bolts 50, 52 (nutted on each end) that pass through legs of angles 46, 48. By threading bolt 47 to vary the distance between angles 46 and 48, the pool wall can be established and maintained plumb (e.g., set in a vertical plane).

Lower attachment mechanism 44 simply comprises a plate 54 that is interconnected with bolts/nuts 56 between pool wall 15 and connecting mechanism 36.

Figure 11:
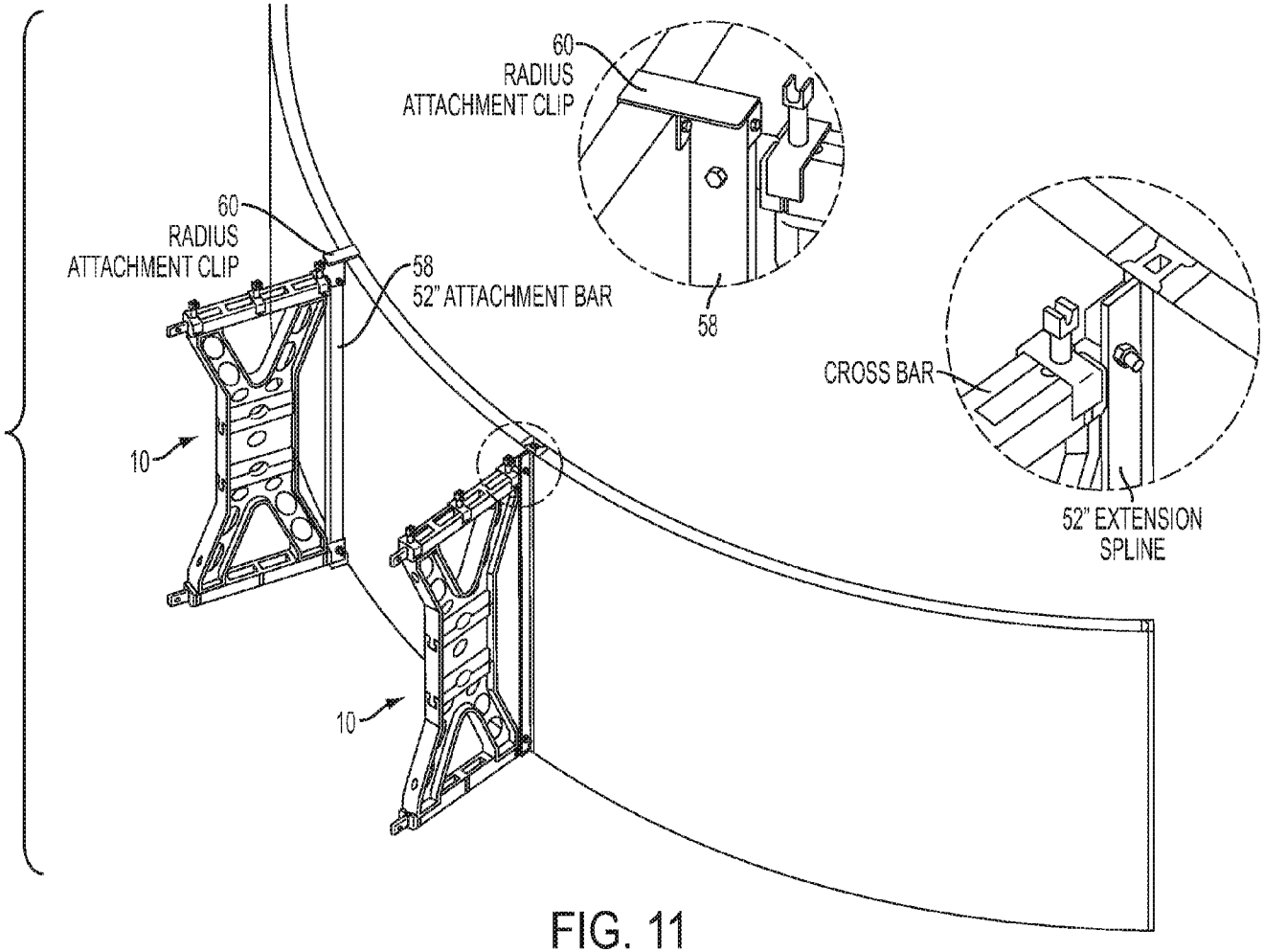
FIG. 11 is a perspective view of the present invention used on pool walls having a radius.
Figure 12A:
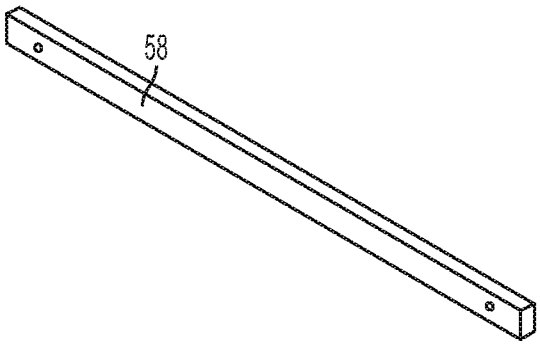
FIGS. 12A-12D are views of a radius pool panel attachment bar.
Figure 12B:
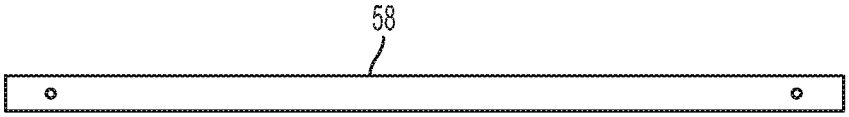
Figure 12C:
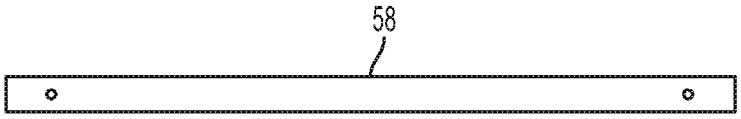
Figure 12D:
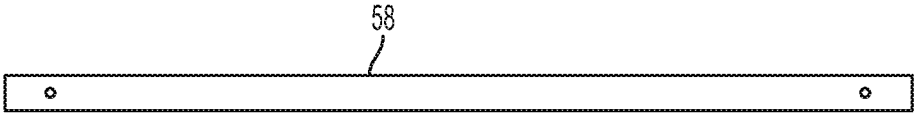
Figure 13A:
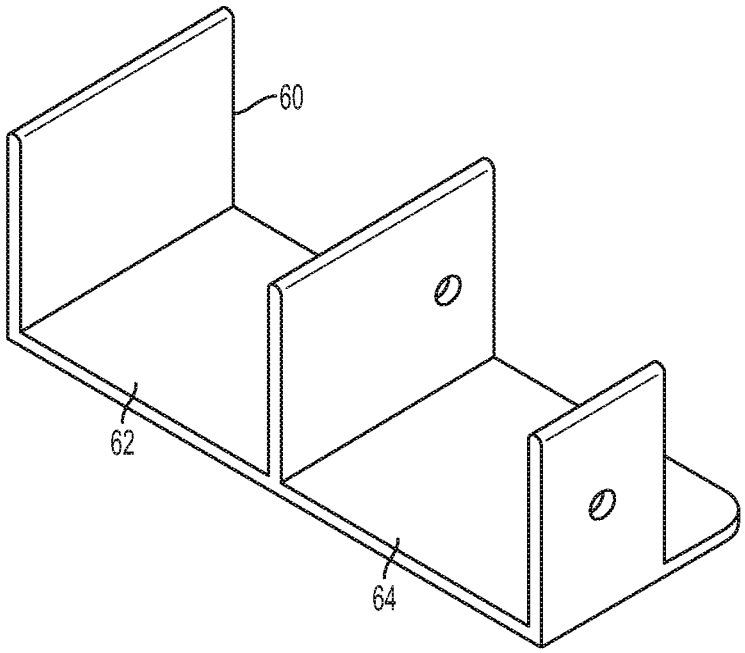
FIGS. 13A-13D are views of a radius pool panel attachment clip.
Figure 13B:
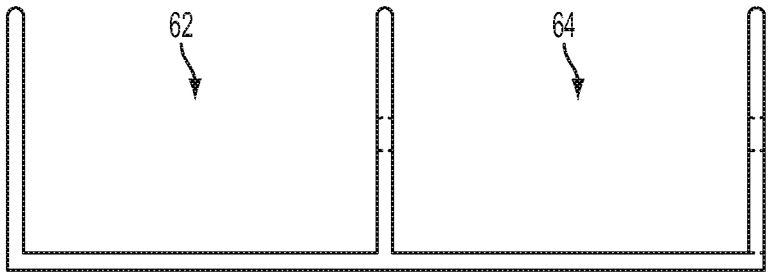
Figure 13C:
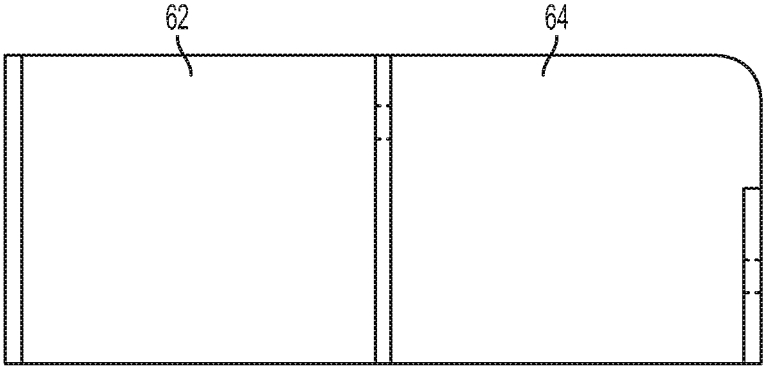
Figure 13D:
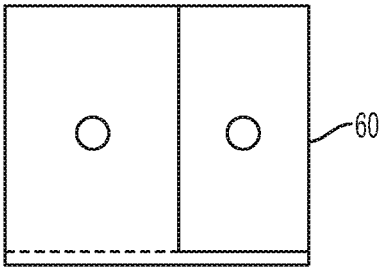
Figure 15:
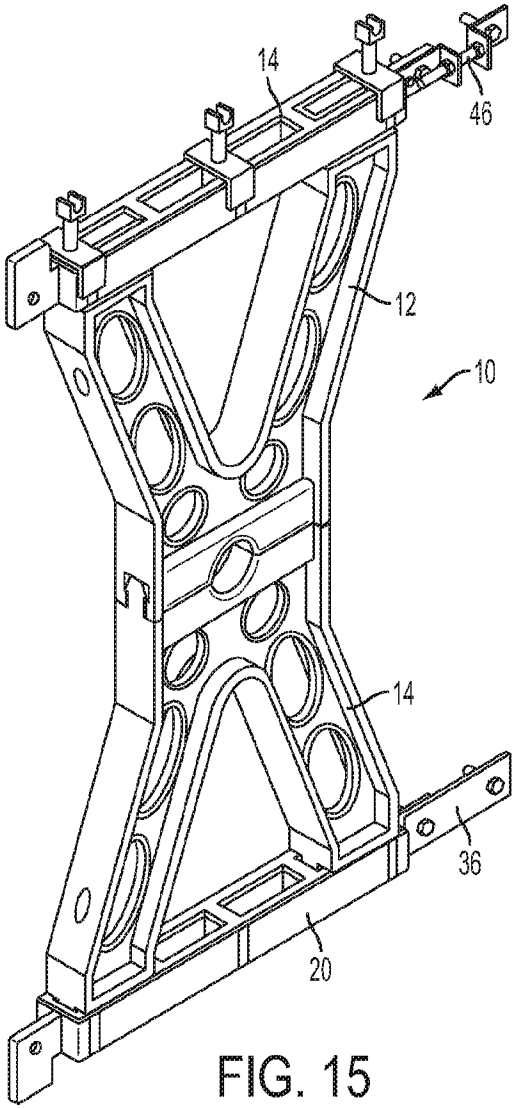
FIG. 15 is a perspective view of an assembled support member.
Figure 14A:
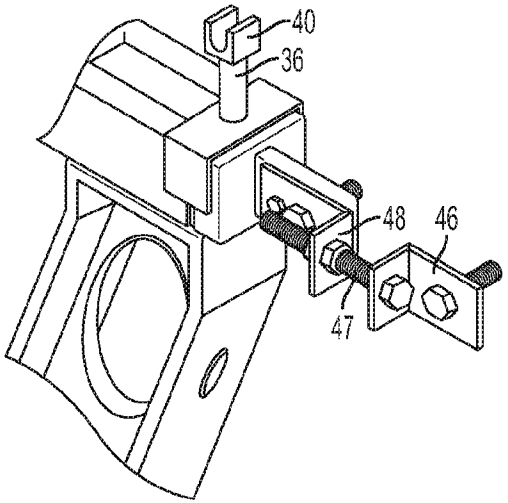
FIGS. 14A-14B are cut-away views of the upper attachment mechanism.
Figure 14B:
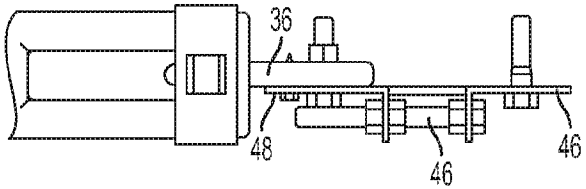
Figure 16A:
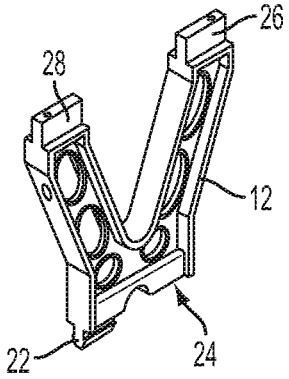
FIGS. 16A-16C are views of a V-shaped half element that forms half of a support member.
Figure 16B:
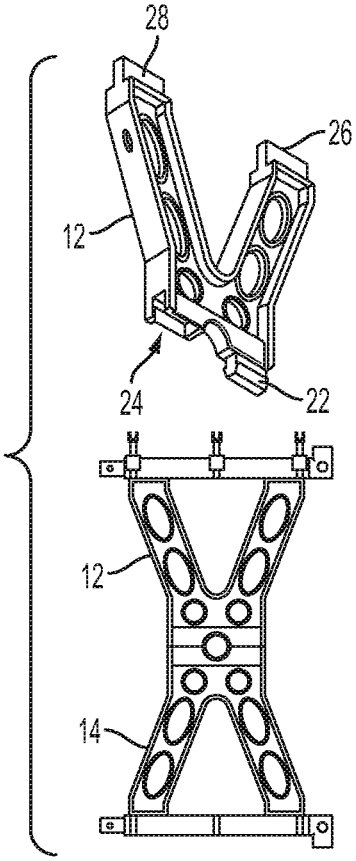
Figure 16C:
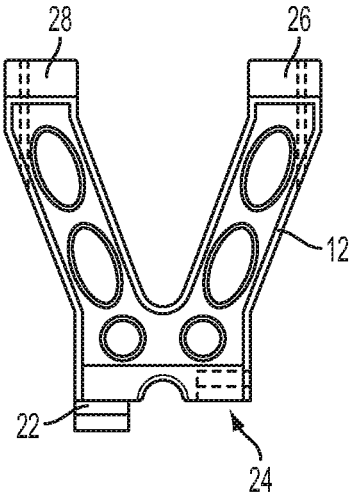
Figure 17B:
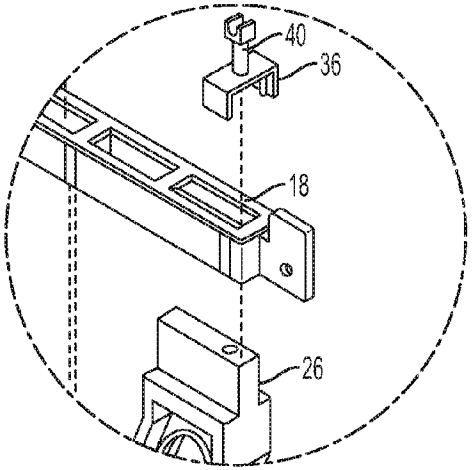
FIGS. 17A-17B are partial cut-away views showing the rebar support clips.
Figure 17A:
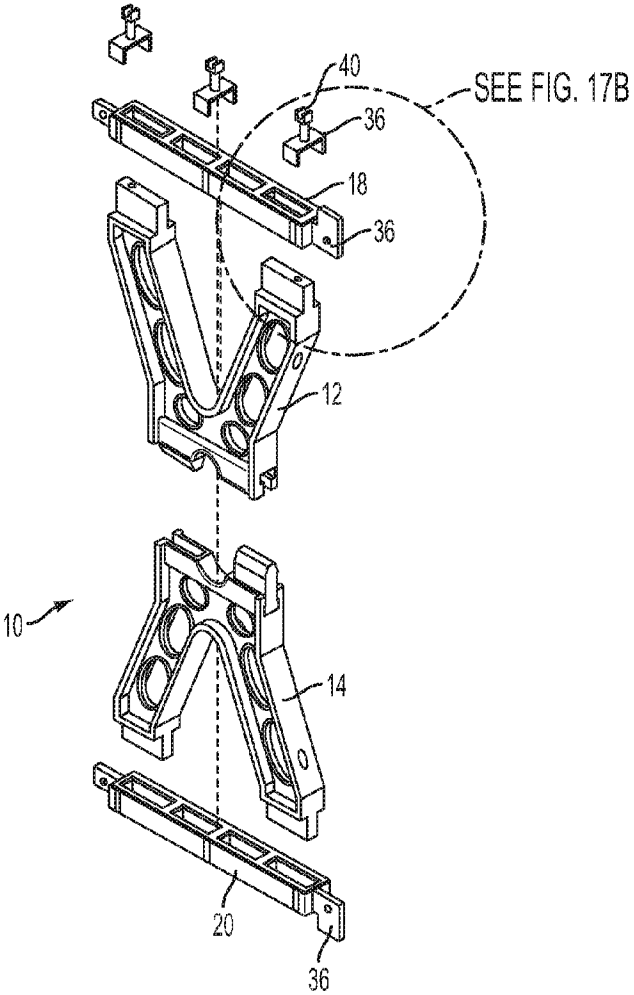
Figure 18A:
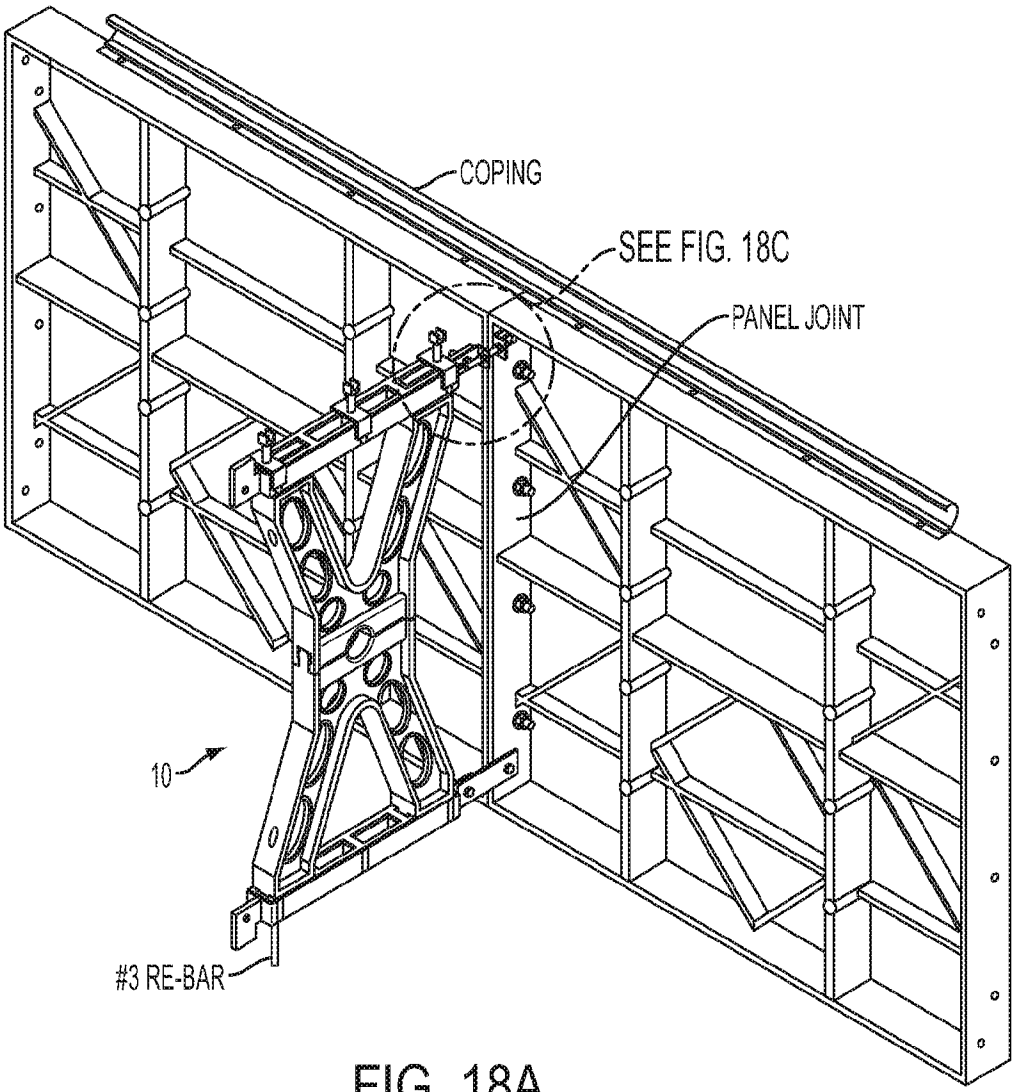
FIGS. 18A-18C are views showing use with a thermoplastic pool wall.
Figure 18B:
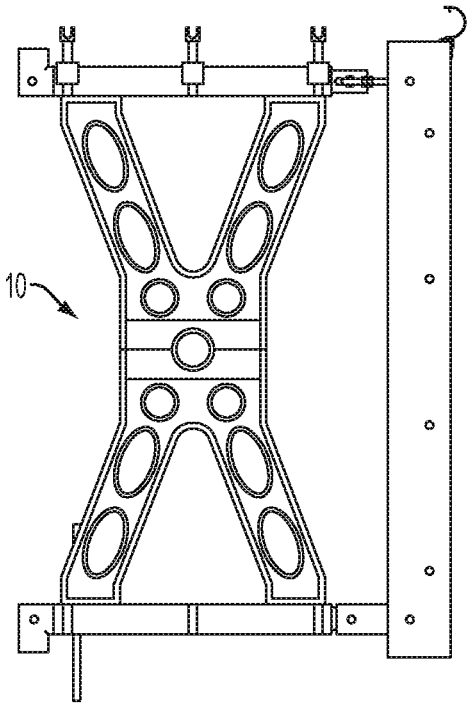
Figure 18C:
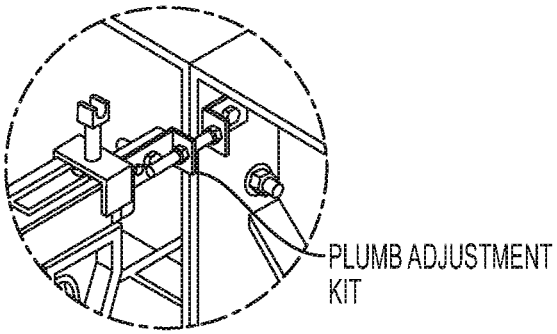
Figure 19B:
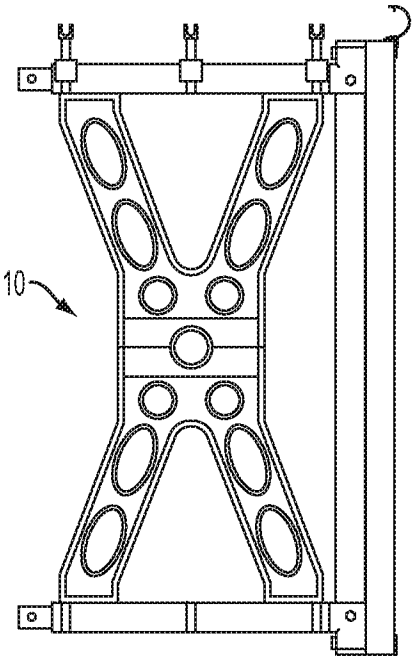
FIGS. 19A-19B are views showing use with a straight pool wall.
Figure 19A:
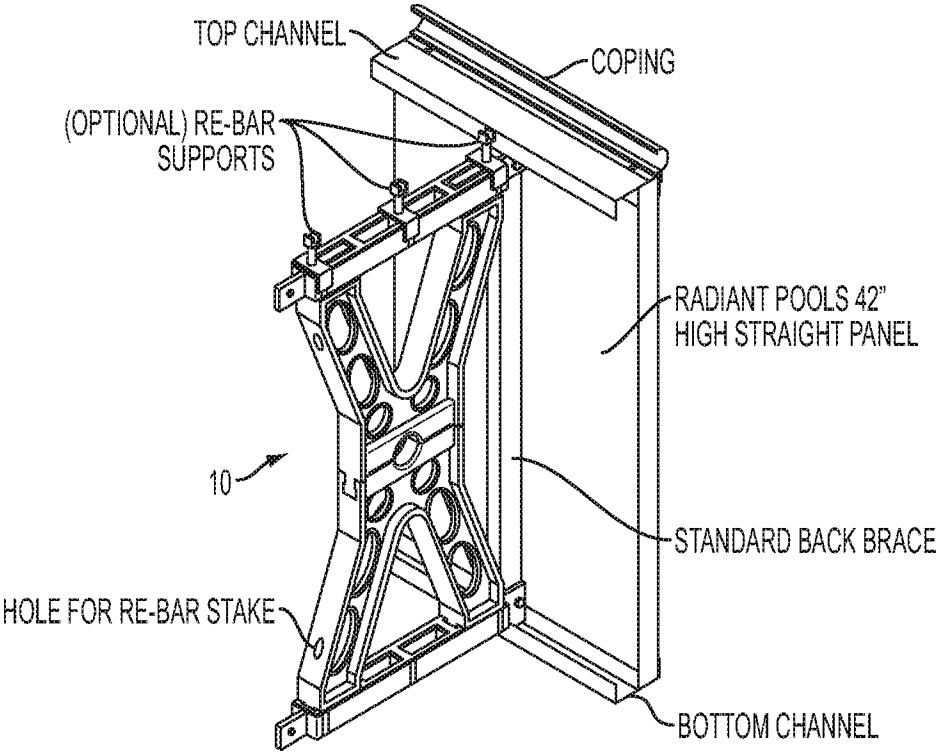
Figure 20B:
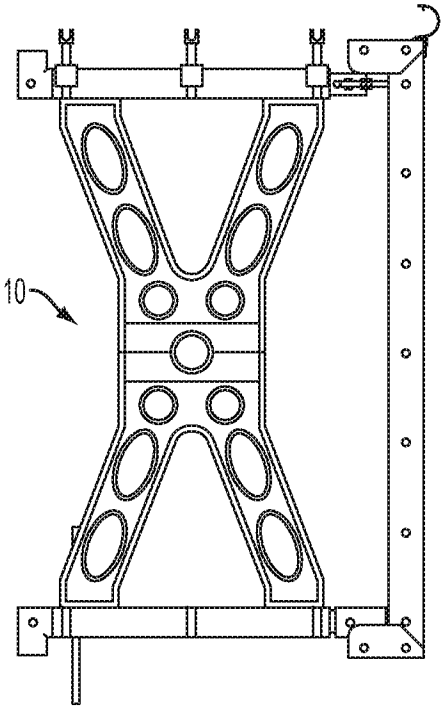
FIGS. 20A-20B are views showing use with a galvanized steel pool wall.
Figure 20A:
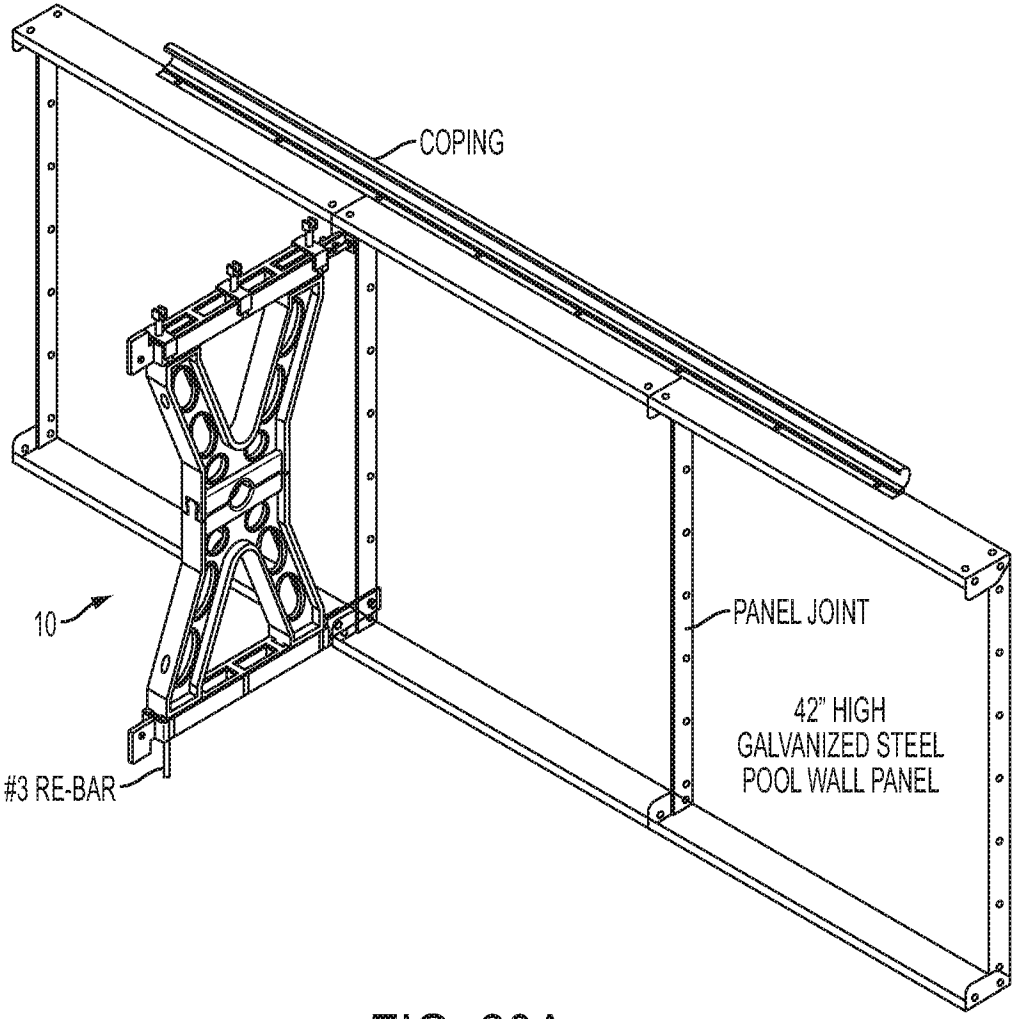

With reference to FIGS. 11-13, when attaching support member to a pool wall having a radius, an attachment bar 58 and attachment clip 60 are utilized. Clip 60 includes a first U-shaped region 62 adapted to securely engage the wall's upper edge, and a second U-shaped region 64 co-linear with and adjacent to the first region 62 that is adapted to securely engage over the top end of attachment bar 58. Attachment bar 58 is vertically oriented to stand adjacent to the wall and is fastened to clip 44 via screws that pass through both the clip 60 and the bar 58. Support member 10 is then fastened to attachment bar 58 using attachment mechanisms 42 and 44.

Once support member 10 is firmly in place relative to pool wall 15, concrete is poured in the bottom of the trench between the undisturbed earth and pool wall 15 to form a concrete bond beam 66. Once hardened, the concrete bond beam 66 will secure the support member 10 in position relative to the pool walls 15.

Back fill may then be used to fill in the space above the concrete bond beam 66 and the remainder of the excavated site between the undisturbed earth and pool walls 15. Once backfilled (or prior to backfilling if desired), steel rebars 68 may be extended between adjacent support members 10, with each length of rebar seated in the yokes 40 that are positioned atop each upper cross bar 18. Once the rebars 68 are in place a concrete deck 70 may be poured over the top of the backfill. The steel rebars 68 will be encapsulated within the concrete deck 70 and the weight of the deck 70 will be fully supported by the support members 10, with each section of decking 70 extending between two adjacent support members 10.

What is claimed is:

1. A pool wall support, comprising:

a first section, wherein said first section comprises first and second legs connected to one another at a first common vertex;

a second section, wherein said second section comprises first and second legs connected to one another at a second common vertex, wherein the second common vertex of said second section is releasable interconnectable with said first common vertex; and a first extension module releasably interconnectable with said first common vertex and said second common vertex such that, when interconnected with said first common vertex and second common vertex, said first extension module is positioned between said first common and said second common vertex.

2. The pool wall support according to claim 1, further comprising a second extension module interconnected to and positioned between one of said first common vertex and second common vertex and said first extension module.

3. The pool wall support according to claim 1, further comprising a first elongated cross member extending between and connected to said first and second legs of said first section.

4. The pool wall support according to claim 3, further comprising at least one rebar support members attached to said first elongated cross member.

5. The pool wall support member according to claim 3, further comprising a first, pool wall connecting member attached to said first elongated cross member.

6. The pool wall support member according to claim 5, further comprising a first attachment mechanism releasably interconnectable with said first pool wall connecting member to the pool wall.

7. The pool wall support according to claim 1, further comprising a second elongated cross member extending between and connected to said first and second legs of said second section.

8. The pool wall support member according to claim 7, further comprising a second, pool wall connecting member attached to said second elongated cross member.

9. The pool wall support member according to claim 8, further comprising a second attachment mechanism releasably interconnectable with said second pool wall connecting member to the pool wall.

10. A pool wall support, comprising:

a first section having first and second legs with first and second terminal ends, respectively, and that diverge from one another from a common, first vertex;

a second section having third and fourth legs with third and fourth terminal ends, respectively, and that diverge from one another from a common, second vertex;

wherein said first and second vertices include first and second fastening mechanisms, respectively, formed thereon, whereby said first and second sections are releasably interconnectable to one another at their respective first and second fastening mechanisms; and a first extension module having first and second opposing edges on which third and fourth fastening mechanisms are formed, respectively, whereby said first extension module is releasably interconnectable to said first and second sections, such that said first extension module is positioned between said first and second sections with said first and third fastening mechanisms and said second and fourth fastening mechanisms engaging, respectively, when interconnected.

11. The pool wall support according to claim 10, further comprising a second extension module having third and fourth opposing edges on which fifth and sixth fastening mechanisms are formed, respectively, whereby said second extension module is releasably interconnectable to said first extension module and one of said first and second sections, such that said second extension module is positioned between said first extension module and one of said first and second section when interconnected.

12. A pool wall support, comprising:

a first section having first and second legs with first and second terminal ends, respectively, and a first edge positioned in spaced relation from said first and second terminal ends;

a second section having third and fourth legs with third and fourth terminal ends, respectively, and a second edge positioned in spaced relation from said third and fourth terminal ends;

wherein said first and second edges include first and second fastening mechanisms, respectively, formed thereon, whereby said first and second sections are releasably interconnectable to one another at their respective first and second fastening mechanisms; and a first extension module having third and fourth opposing edges on which third and fourth fastening mechanisms are formed, respectively, whereby said first extension module is releasably interconnectable to said first and second sections such that said first extension module is positioned between said first and second sections with said first and third fastening mechanisms and said second and fourth fastening mechanisms engaging, respectively, when interconnected.

13. The pool wall support according to claim 12, further comprising a second extension module having fifth and sixth opposing edges on which fifth and sixth fastening mechanisms are formed, respectively, whereby said second extension module is adapted to interconnect to and be positioned between said first extension module and one of said first and second sections.

* * * * *